US011000441B2

(12) United States Patent
Knipper

(10) Patent No.: US 11,000,441 B2
(45) Date of Patent: May 11, 2021

(54) FOLDABLE ARM FOR WALKER

(71) Applicant: Alexander McEnery Knipper, Upland, CA (US)

(72) Inventor: Alexander McEnery Knipper, Upland, CA (US)

( * ) Notice: Subject to any disclaimer, the term of this patent is extended or adjusted under 35 U.S.C. 154(b) by 0 days.

(21) Appl. No.: 16/538,333

(22) Filed: Aug. 12, 2019

(65) Prior Publication Data

US 2021/0045961 A1 Feb. 18, 2021

(51) Int. Cl.
*A61H 3/04* (2006.01)
*A45B 9/00* (2006.01)

(52) U.S. Cl.
CPC ..... *A61H 3/04* (2013.01); *A45B 2009/007* (2013.01); *A61H 2201/0161* (2013.01); *A61H 2201/1635* (2013.01)

(58) Field of Classification Search
CPC ..... B62B 3/002; A61H 3/04
See application file for complete search history.

(56) References Cited

U.S. PATENT DOCUMENTS

| | | | |
|---|---|---|---|
| 2,293,168 | A | 8/1942 | Pirone |
| 2,594,605 | A | 4/1952 | Zoppelt |
| 2,657,944 | A | 11/1953 | Miller |
| 3,428,282 | A | 2/1969 | Pernice |
| 3,968,810 | A | 7/1976 | Thomas |
| 4,012,059 | A | 3/1977 | Luke et al. |
| 4,094,330 | A | 6/1978 | Jong |
| 4,616,668 | A | 10/1986 | Battiston |
| 4,995,412 | A | 2/1991 | Hirn et al. |
| 5,433,235 | A | 7/1995 | Miric et al. |
| 5,529,425 | A | 6/1996 | Spies et al. |
| 5,702,010 | A | 12/1997 | Liang |
| 6,196,494 | B1 | 3/2001 | Rollins et al. |
| 6,213,672 | B1 | 4/2001 | Varga |
| 7,278,436 | B2 | 10/2007 | Gale et al. |
| 7,363,931 | B2 | 4/2008 | Weaver |
| 7,373,942 | B1 | 5/2008 | Yeager |
| 7,931,036 | B1 | 4/2011 | Hobbs |
| 8,906,021 | B1 | 12/2014 | Lehmann et al. |
| 9,358,175 | B2 | 6/2016 | Bordan |

(Continued)

FOREIGN PATENT DOCUMENTS

| | | |
|---|---|---|
| EP | 0541935 A2 | 5/1993 |

*Primary Examiner* — John D Walters
*Assistant Examiner* — James J Triggs
(74) *Attorney, Agent, or Firm* — Ivan Posey, Esq.; Leech Tishman Fuscaldo & Lampl

(57) ABSTRACT

An adjustable height foldable arm comprises a lower vertical tube, an inner guide slideably inserted into the lower vertical tube fitting into the lower vertical slot, an inner guide slot, an inner guide hole, a lower vertical tube hole through the lower vertical tube, a first rod inserted through the lower vertical tube hole and the inner guide hole to secure the inner guide in the lower vertical slot, an upper vertical tube with an upper vertical slot in which the inner guide is slideably inserted, an outer tube providing vertical height adjustment and rotational movement, an outer vertical slot on both sides of the outer tube allowing vertical movement with respect to the rod, and two outer horizontal slots on the outer tube allowing for positioned rotational movement of the outer tube when the upper vertical tube is at its lowest vertical displacement.

6 Claims, 5 Drawing Sheets

(56) References Cited

U.S. PATENT DOCUMENTS

| | | | | |
|---|---|---|---|---|
| 10,058,474 | B1 * | 8/2018 | Knipper | A61H 3/04 |
| 2003/0233718 | A1 | 12/2003 | Heathcock et al. | |
| 2006/0096626 | A1 | 5/2006 | Weaver | |
| 2007/0031187 | A1 | 2/2007 | McNeal et al. | |
| 2011/0001315 | A1 | 1/2011 | Fischer et al. | |
| 2013/0047331 | A1 | 2/2013 | Parker et al. | |
| 2015/0080892 | A1 | 3/2015 | Lehmann et al. | |
| 2015/0320631 | A1 | 11/2015 | Bordan | |

* cited by examiner 4
23
22
20
19
18
3
16
19
19
2
14
19
1
8
8

4
24
10
30
19
A
A
19
19
19
2
1
8
8

FOLDABLE ARM FOR WALKER

CROSS-REFERENCE TO RELATED APPLICATIONS

This application is a continuation of pending U.S. patent application Ser. No. 16/114,030 titled "FOLDABLE ARM FOR WALKER" and filed on Aug. 27, 2018, which is a continuation of U.S. patent application Ser. No. 15/838,288 titled "FOLDABLE ARM FOR WALKER", filed on Dec. 11, 2017, the contents of which are incorporated herein in their entirety.

FIELD OF THE INVENTION

This invention generally relates to a foldable arm for a walker. More specifically, the present invention relates to a foldable arm that can be used for a walker that comprises a novel height adjustment and folding mechanism.

SUMMARY OF THE INVENTION

In accord with a preferred embodiment, an adjustable height foldable arm comprises a lower vertical tube, a lower vertical slot tracking up the lower vertical tube, an inner guide slideably inserted into the lower vertical tube fitting into the lower vertical slot, the inner guide comprising an elongated flat bar, an inner guide slot in the middle of the inner guide, an inner guide hole below the inner guide slot, a lower vertical tube hole through the lower vertical tube, a first rod inserted through the lower vertical tube hole and the inner guide hole to secure the inner guide in the lower vertical slot, an upper vertical tube with an upper vertical slot in which the inner guide is slideably inserted, the upper vertical tube comprising one or more vertical locking holes, a horizontal locking hole, and an upper vertical tube lower hole, a second rod inserted through the inner guide slot and the upper vertical tube lower hole to slideably secure the upper vertical tube the inner guide, an outer tube providing vertical height adjustment and rotational movement, an outer vertical slot on both sides of the outer tube allowing vertical movement with respect to the second rod, and two outer horizontal slots on the outer tube allowing for positioned rotational movement of the outer tube when the upper vertical tube is at its lowest vertical displacement.

DETAILED DESCRIPTION OF THE PREFERRED EMBODIMENTS

Figure 1:
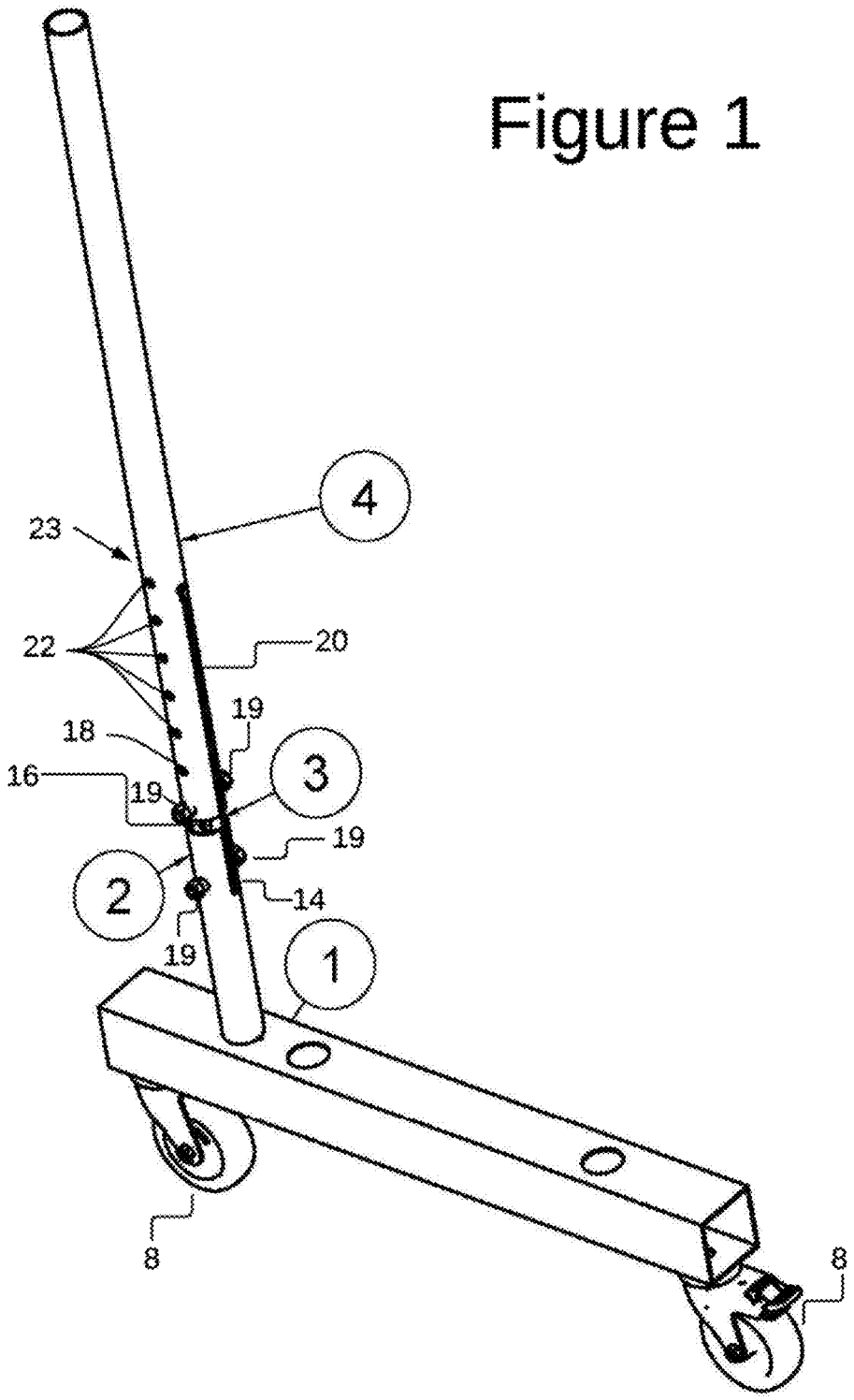
FIG. 1 is a diagrammatic inner perspective view of a foldable arm is shown according to one embodiment.

For the purpose of illustrating the invention, there is shown in the accompanying drawings several embodiments of the invention. However, it should be understood by those of ordinary skill in the art that the invention is not limited to the precise arrangements and instrumentalities shown therein and described below.

The method and system for a foldable arm for a walker of the present invention and is illustrated in FIGS. 1-4 wherein like reference numerals are used throughout to designate like elements.

With reference to FIG. 1, an inner left or right perspective view of a foldable arm is illustrated according to one embodiment. A base portion 1 of, by way of example and not by way of limitation, may comprise the base of a walker used to assist the physically impaired for walking. For example, those skilled in the art would recognize that the base 1 of a walker may include casters 8 that may roll on surfaces during walking. A lower vertical tube 2 may be arc welded to the base 1 at a right angle. A lower vertical slot 14 that may track up the lower vertical tube 2, by way of example and not by way of limitation, vertically at the midpoint of the width of the base 1. The lower vertical slot 14 may start at a point above the base 1 up the lower vertical tube 2 and is open at the top of the lower vertical tube 2.

An inner guide 3 comprises an elongated flat rectangular bar with an inner guide slot 16 down the middle above inner guide slot hole 17. The inner guide 3 is slideably inserted into the lower vertical tube 2, fitting into the lower vertical slot 14 with the sides of the inner guide 3 fitting flush with the outer surface of the lower vertical tube 2. The inner guide 3 is secured by means of nuts 19, threaded rod 13, bushing 21, inserted through both inner guide hole 17 and lower vertical tube hole 15.

An upper vertical tube 4 has an upper vertical slot 20 in which the inner guide 3 is slideably inserted such that the sides of the inner guide 3 fit flush with the outer service of the upper vertical tube 4. The upper vertical tube 4 contains vertical locking holes 22, horizontal locking hole 23, upper vertical tube lower hole 18. As with the inner guide 3, the upper vertical tube 4 is secured by means of nuts 19, threaded rod 13, bushing 21, inserted through both inner guide slot 16 and upper vertical tube lower hole 18.

In other words, the inner guide 3 allows the upper vertical tube 4 to rise up and down, with the nuts 19, threaded rod 13, bushing 21, rising up and down the inner guide slot 16. In one embodiment, the upper and lower vertical tubes 2 and 4 may contain a series of nuts, threaded rod, and bushings through the inner guide hole 18 and inner guide slot 16 to control both vertical and rotational movement.

Figure 2:
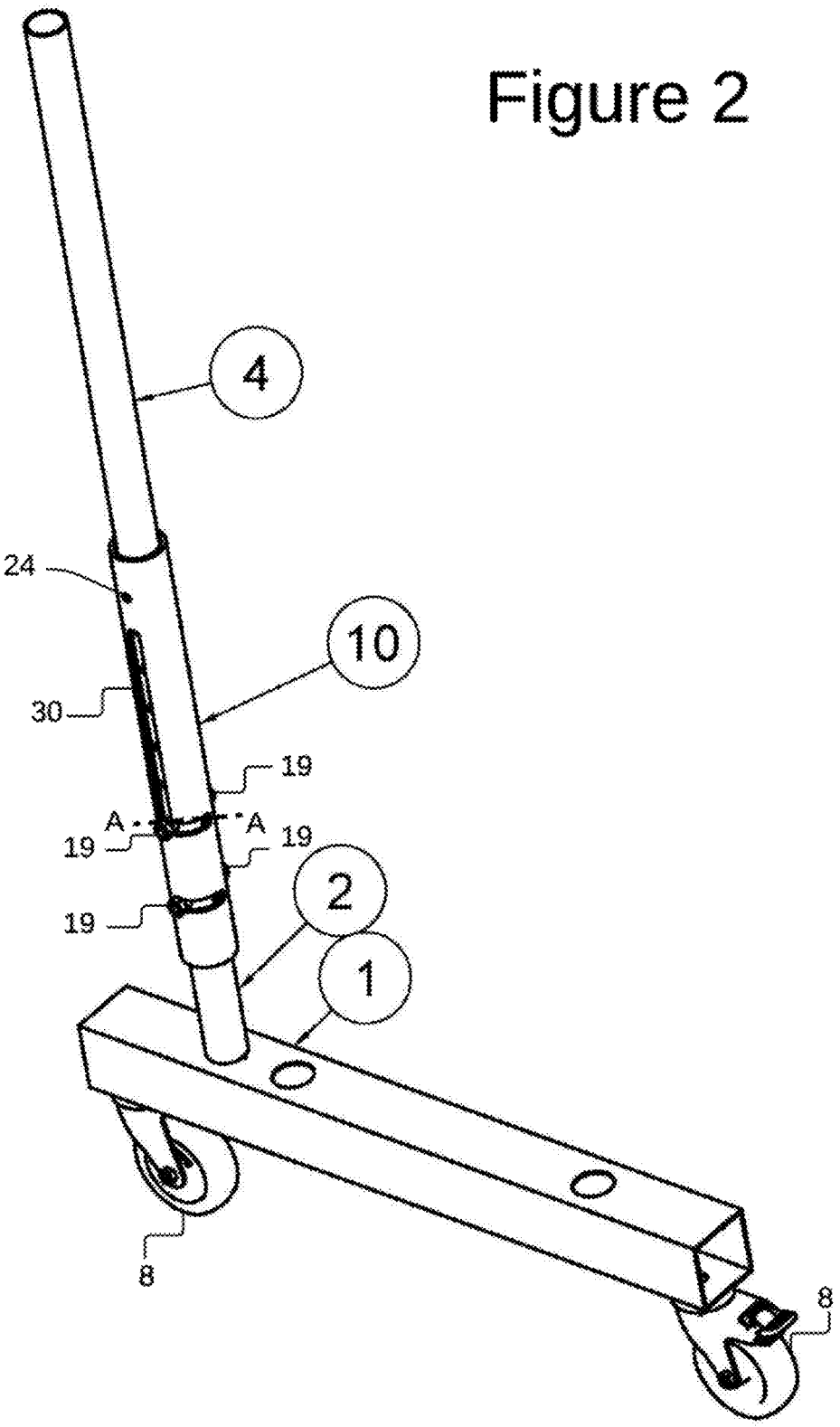
FIG. 2 is a left perspective view of the embodiment of FIG. 1 with the outer components installed.

With reference to FIG. 2 a left perspective view of the foldable arm embodiment of FIG. 1 with the outer components installed is shown. FIG. 2 illustrates how the outer components are used to control both vertical and rotational movement. Both the upper vertical tube 4 and lower vertical tube 2 contain a series of nuts, threaded rods, and bushings inserted through the inner guide 3 (not shown) to control both vertical and rotational movement. The outer tube 10 is used to control the vertical height adjustment as well as the rotational movement for folding. Rotational movement does not occur when vertical displacement occurs during positive vertical movement of the outer tube 10. An outer vertical slot 30 on both sides of the outer tube 10 ensures accurate vertical movement of the nuts 19, threaded rod 13, and bushing 21. Counter-clockwise rotational movement of up to 90 degrees may occur when the upper vertical tube 4 is at its lowest vertical displacement (and therefore the nuts 19, threaded rod 13, and bushing 21 are within the within the outer vertical slot 30). FIG. 2 shows counter-clockwise movement when the upper vertical tube 4 is at its lowest vertical displacement. The counter-clockwise rotational movement is allowed through two outer horizontal slots 32 (one on each side for the nuts 19) that connect perpendicularly with the two outer vertical slots 30. Outer horizontal slots 32 can be reversed to change rotational movement from counter-clockwise to clockwise in a right foldable arm configuration. Vertical height of upper vertical tube 4 is secured by inserting a cylindrical bar through outer lock hole 24 and vertical locking holes 22. Horizontal movement is secured by inserting a cylindrical bar through outer lock hole 24 and folding locking hole 23 after 90 degree counter-clockwise movement of all parts of the foldable arm while outer tube 10 remains stationary. Contained at both ends (top and bottom) of the outer tube 10 may be two fiberglass/epoxy bearings 5 to withstand the heat from, for example, arc welding processes.

Figure 3:
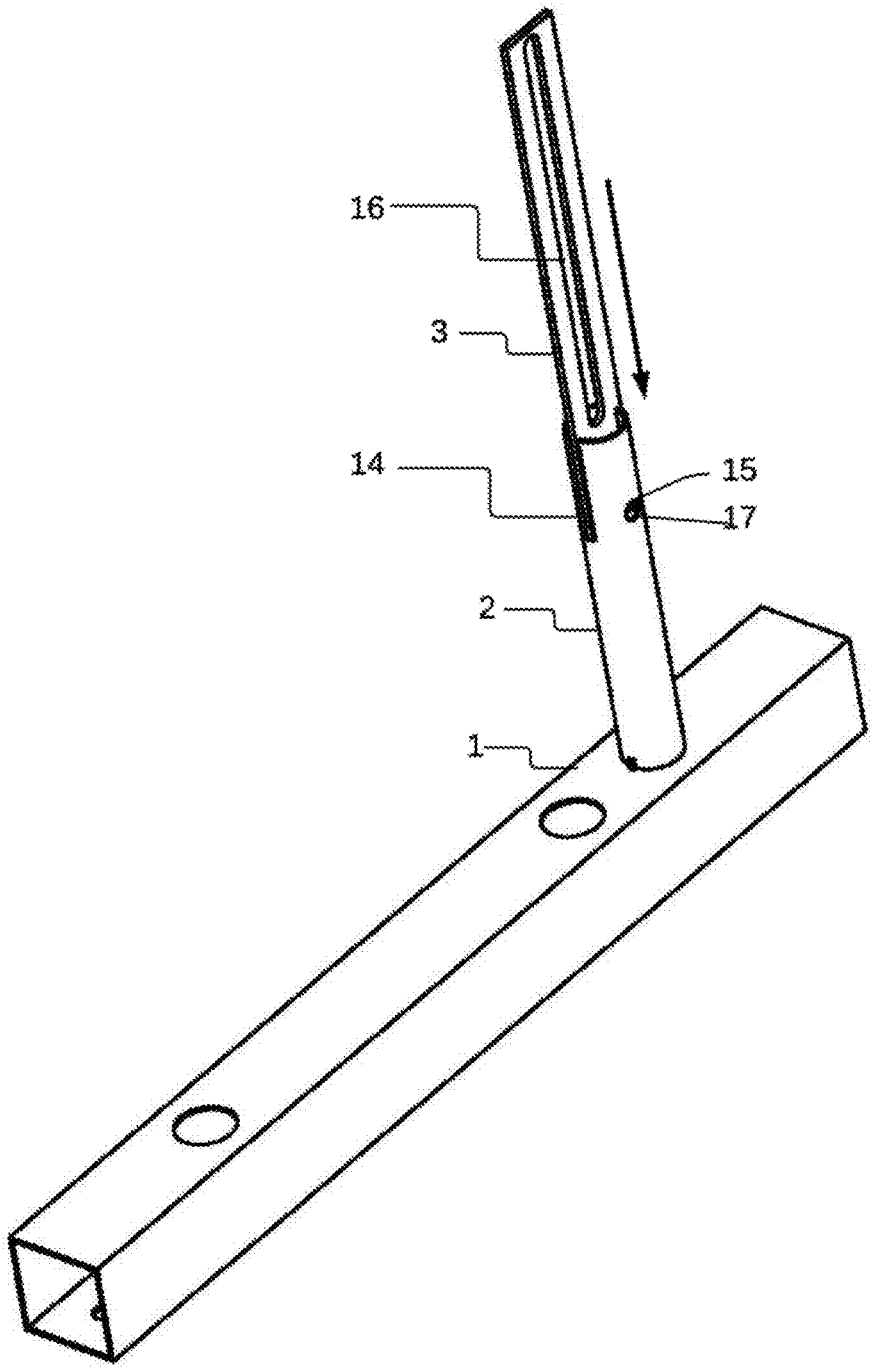
With reference to FIG. 3 is a left or right rear perspective view of the disassembled apparatus according to the embodiments of FIGS. 1-2.

With reference to FIG. 3, a rear perspective view of the disassembled apparatus according to the embodiments of FIGS. 1-2 is shown. In FIG. 3, only the base 1, lower vertical tube 2, and inner guide are shown. In particular, the inner guide 3 is shown in mid-assembly, and being inserted into the lower vertical tube 2 into the lower vertical slot 14 in the direction of the arrow before any nuts 19, threaded rod 13, and bushing 21 are inserted through the inner guide hole 17 and lower vertical hole 15.

Figure 4:
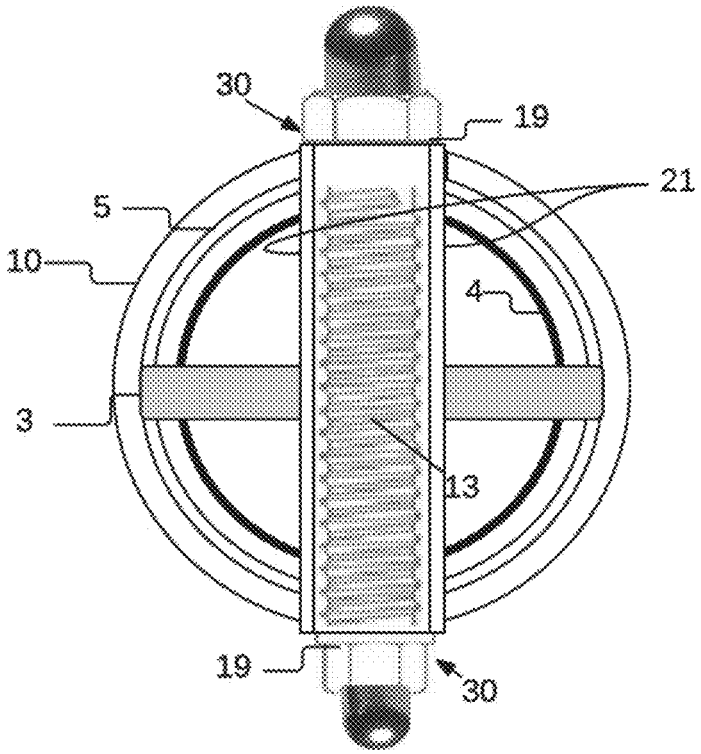
FIG. 4 is a top cross-sectional view of the upper vertical tube at line A in FIG. 2.

With reference to FIG. 4, a top cross-sectional view of the upper vertical tube at line A in FIG. 2 is shown. The outer tube 10 contains the two outer vertical slots 30 on each side through which the threaded rod 13 and bushing 21 protrude through and travel vertically and rotationally. The threaded rod 13 and bushing 21 are also positioned through the inner guide slot 16 and upper vertical tube lower hole 18. Attached on either side of threaded rod 13 are nuts 19 flush with the ends of bushing 21. FIG. 4 also clearly shows that inner guide 3 is wider than the lower vertical tube 2 and upper vertical tube 4 yet not as wide as the inner diameter of outer tube 4.

Further, in one embodiment, inserted between the outer tube 2 and the upper vertical tube 4 and lower vertical tube 2 may be a fiberglass/epoxy bearing 5, which may provide smooth and accurate vertical and rotational movement and withstand heat during the arc welding manufacturing process.

Figure 5:
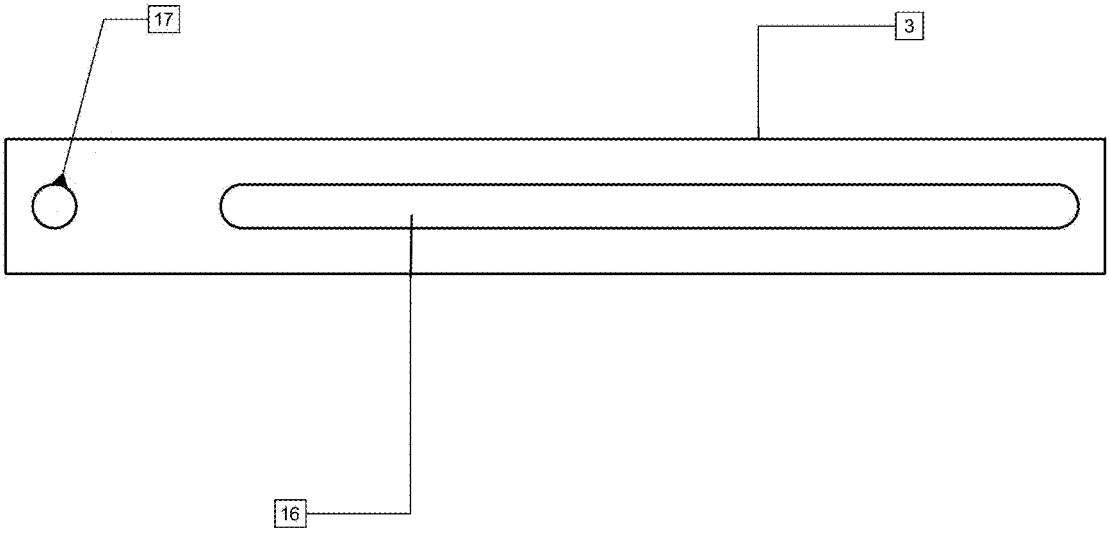
FIG. 5 is a top elevational view of the inner guide according to the embodiment of FIGS. 1-4.

With reference to FIG. 5, a top elevational view of the inner guide 3 is shown according to the embodiment of FIGS. 1-4. The general orientation of the inner guide slot hole 17 to the inner guide slot 16 is shown.

The various embodiments described above are provided by way of illustration only and should not be construed to limit the invention. Those skilled in the art will readily recognize various modifications and changes that may be made to the claimed invention without following the example embodiments and applications illustrated and described herein, and without departing from the true spirit and scope of the claimed invention, which is set forth in the following claims.

For example, those of skill in the art would recognize that the invention described herein could be applied to wheelchairs, rollators and crutches.

What is claimed is:

1. An adjustable height foldable arm, comprising:

a lower vertical tube;

a lower vertical slot tracking up the lower vertical tube;

an inner guide slideably inserted into the lower vertical tube fitting into the lower vertical slot, the inner guide comprising an elongated flat bar;

an inner guide slot in the middle of the inner guide;

an inner guide hole below the inner guide slot;

a lower vertical tube hole through the lower vertical tube;

a first rod inserted through the lower vertical tube hole and the inner guide hole to secure the inner guide in the lower vertical slot;

an upper vertical tube with an upper vertical slot in which the inner guide is slideably inserted, the upper vertical tube comprising one or more vertical locking holes, a horizontal locking hole, and an upper vertical tube lower hole;

a second rod inserted through the inner guide slot and the upper vertical tube lower hole to slideably secure the upper vertical tube the inner guide;

an outer tube providing vertical height adjustment and rotational movement;

an outer vertical slot on both sides of the outer tube allowing vertical movement with respect to the second rod; and one or more outer slots on the outer tube allowing for positioned rotational movement of the outer tube when the upper vertical tube is at its lowest vertical displacement.

2. The foldable arm of claim 1, further comprising a base connected to the lower vertical tube.

3. The foldable arm of claim 2, wherein the base comprises the base of a walker.

4. The foldable arm of claim 3, wherein the lower vertical slot is cut vertically at the midpoint of the width of the base.

5. The foldable arm of claim 1, wherein the first and second rods each further comprise a thread rod with a bushing and two nuts.

6. The foldable arm of claim 1, further comprising a bearing inserted between the outer tube and the upper vertical tube and lower vertical tube.

* * * * *